US008696307B2

(12) United States Patent
Garrett

(10) Patent No.: US 8,696,307 B2
(45) Date of Patent: Apr. 15, 2014

(54) VARIABLE GEOMETRY TURBINE

(75) Inventor: Stephen Edward Garrett, Huddersfield (GB)

(73) Assignee: Cummins Ltd., Huddersfield (GB)

( * ) Notice: Subject to any disclaimer, the term of this patent is extended or adjusted under 35 U.S.C. 154(b) by 776 days.

(21) Appl. No.: 12/877,609

(22) Filed: Sep. 8, 2010

(65) Prior Publication Data

US 2011/0116911 A1 May 19, 2011

(30) Foreign Application Priority Data

Sep. 8, 2009 (GB) ..... 0915621.7

(51) Int. Cl.
*F04D 29/56* (2006.01)

(52) U.S. Cl.
USPC ..... 415/157

(58) Field of Classification Search
USPC ..... 415/157
See application file for complete search history.

(56) References Cited

U.S. PATENT DOCUMENTS

| | | | | |
|---|---|---|---|---|
| 4,082,817 | A | 4/1978 | Imaizumi et al. | |
| 5,214,920 | A * | 6/1993 | Leavesley | 60/602 |
| 5,794,445 | A | 8/1998 | Dungner | |
| 5,868,552 | A | 2/1999 | McKean et al. | |
| 5,941,684 | A | 8/1999 | Parker | |
| 6,443,696 | B1 | 9/2002 | Erdmann et al. | |
| 2004/0025504 | A1 | 2/2004 | Perrin et al. | |
| 2009/0053044 | A1 | 2/2009 | Ward | |
| 2009/0060737 | A1 | 3/2009 | Frankenstein et al. | |

FOREIGN PATENT DOCUMENTS

| | | | |
|---|---|---|---|
| EP | 0 571 205 | A1 | 11/1993 |
| GB | 475622 | | 11/1937 |
| GB | 2 408 779 | A | 6/2005 |
| WO | WO 00/73630 | A1 | 12/2000 |
| WO | WO 02/44527 | A1 | 6/2002 |
| WO | WO 2005/059317 | A1 | 6/2005 |
| WO | WO 2005/106210 | | 11/2005 |
| WO | WO 2007/107289 | | 9/2007 |

OTHER PUBLICATIONS

United Kingdom Search Report, GB0915621.7, Jan. 4, 2010.

* cited by examiner

*Primary Examiner* — Dwayne J White
(74) *Attorney, Agent, or Firm* — Krieg DeVault LLP; Clifford W. Browning

(57) ABSTRACT

A variable geometry turbine comprises a turbine wheel supported in a housing for rotation about a turbine axis. An exhaust gas inlet passageway is defined between a shroud and a wall of a nozzle ring. The shroud is moveable in the axial direction to vary the size of the inlet passageway. The nozzle ring has an array of vanes that extends across the inlet passageway. An array of openings is provided in the shroud for receipt of the array of vanes. The shroud is part of a substantially annular axially moveable sleeve that is slidably disposed on an annular supporting wall. At least one biasing member is disposed between the moveable sleeve and the support and is designed to apply a circumferentially distributed force in the radial direction so as to maintain concentric alignment of the supporting wall and the sleeve.

15 Claims, 3 Drawing Sheets

VARIABLE GEOMETRY TURBINE

CROSS REFERENCE TO RELATED APPLICATIONS

The present application claims priority to United Kingdom Patent Application No. 0915621.7 filed Sep. 8, 2009, which is incorporated herein by reference.

The present invention relates to a variable geometry turbine. The variable geometry turbine may, for example, form a part of a turbocharger.

Turbochargers are well known devices for supplying air to an intake of an internal combustion engine at pressures above atmospheric pressure (boost pressures). A conventional turbocharger essentially comprises an exhaust gas driven turbine wheel mounted on a rotatable shaft within a turbine housing connected downstream of an engine outlet manifold. Rotation of the turbine wheel rotates a compressor wheel mounted on the other end of the shaft within a compressor housing. The compressor wheel delivers compressed air to an engine intake manifold. The turbocharger shaft is conventionally supported by journal and thrust bearings, including appropriate lubricating systems, located within a central bearing housing connected between the turbine and compressor wheel housings.

The turbine stage of a typical turbocharger comprises: a turbine chamber within which the turbine wheel is mounted; an annular inlet passageway defined between facing radial walls arranged around the turbine chamber; an inlet volute arranged around the inlet passageway; and an outlet passageway extending from the turbine chamber. The passageways and chamber communicate such that pressurised exhaust gas admitted to the inlet volute flows through the inlet passageway to the outlet passageway via the turbine and rotates the turbine wheel. It is also known to improve turbine performance by providing vanes, referred to as nozzle vanes, in the inlet passageway so as to deflect gas flowing through the inlet passageway towards the direction of rotation of the turbine wheel.

Turbines may be of a fixed or variable geometry type. Variable geometry turbines differ from fixed geometry turbines in that the size of the inlet passageway can be varied to optimise gas flow velocities over a range of mass flow rates so that the power output of the turbine can be varied to suit varying engine demands. For instance, when the volume of exhaust gas being delivered to the turbine is relatively low, the velocity of the gas reaching the turbine wheel is maintained at a level which ensures efficient turbine operation by reducing the size of the annular inlet passageway using a variable geometry mechanism. Turbochargers provided with a variable geometry turbine are referred to as variable geometry turbochargers.

Nozzle vane arrangements in variable geometry turbochargers can take different forms. In one type, known as a "sliding nozzle ring", the vanes are fixed to an axially movable wall that slides across the inlet passageway. The axially movable wall moves towards a facing shroud plate in order to close down the inlet passageway and in so doing the vanes pass through apertures in the shroud plate. Alternatively, the nozzle ring is fixed to a wall of the turbine and a shroud plate is moved over the vanes to vary the size of the inlet passageway.

The moving component of the variable geometry mechanism, whether it is the nozzle ring or the shroud plate, is supported for axial movement in a cavity in a part of the turbocharger housing (usually either the turbine housing or the turbocharger bearing housing). It may be sealed with respect to the cavity walls to reduce or prevent leakage flow around the back of the nozzle ring.

The component of the variable geometry mechanism is axially displaced by a suitable actuator assembly comprising an actuator and a linkage. An example of such a known actuator assembly is disclosed in U.S. Pat. No. 5,868,552. The linkage comprises a yoke pivotally supported within the bearing housing and having two arms, each of which extends into engagement with an end of a respective push rod on which the moving component (in this instance the nozzle ring) is mounted. The yoke is mounted on a shaft journaled in the bearing housing and supporting a crank external to the bearing housing which may be connected to the actuator in any appropriate manner. The actuator which moves the yoke can take a variety of forms, including pneumatic, hydraulic and electric forms, and can be linked to the yoke in a variety of ways. The actuator will generally adjust the position of the moving component under the control of an engine control unit (ECU) in order to modify the airflow through the turbine to meet performance requirements.

In use, a torque may be imparted to the nozzle ring as a result of gas flow in the turbine. This is particularly the case if the nozzle ring is provided with a plurality of vanes arranged, in use, to deflect gas flowing through the inlet passageway of the turbine towards the direction of rotation of the turbine wheel. If the nozzle ring is the moving part of the variable geometry mechanism this torque has to be reacted or otherwise accommodated by the actuator assembly such as by parts of the linkage. It is also necessary to accommodate differential thermal expansion of the moving component and the linkage and generally the connection between the linkage and the moving component is relatively stiff in a first radial direction but relatively compliant in a perpendicular second radial direction. In addition to these withstanding the aforementioned loads the linkage has to control the axial position of the moving component under the influence of the actuator. Moreover, there can be friction between, and wear of, the moving parts of the variable geometry mechanism. In some circumstances, over-constraint in the first radial direction and wear of components can lead to jamming of the mechanism.

It is one object of the present invention to obviate or mitigate the aforesaid disadvantages. It is also an object of the present invention to provide for an improved or alternative variable geometry mechanism and turbine According to the present invention there is provided a variable geometry turbine comprising a turbine wheel supported in a housing for rotation about a turbine axis, an inlet passageway defined between a first wall and second fixed wall, the first wall being moveable relative to the second wall in the direction of the turbine axis to vary the size of the inlet passageway, an array of vanes extending across the inlet passageway and fixed to one of the first and second walls, the first wall being moveable by a substantially annular axially moveable member that is supported by an substantially annular support, and at least one biasing member disposed between the moveable member and the support, the biasing member applying a substantially circumferentially distributed force in substantially the radial direction so as to maintain substantial concentric alignment of the annular support and the annular axially moveable member.

The distribution of the substantially radial force in the circumferential direction ensures that the moveable member is kept centred relative to the support. It will be appreciated that force will be applied (directly or indirectly) to both the axially moveable member and the support for the centring to occur and will be generally symmetrical.

The biasing member effectively operates to maintain an annular clearance between the support and the moveable member that is of substantially constant radial dimension around its extent, whilst permitting relative axial movement between the support and the moveable member.

The at least one biasing member may be radially resilient. It is also preferably annular.

The at least one biasing member may have an outer peripheral surface and an inner peripheral surface, and is deformable in the radial direction such that the outer peripheral surface is moveable radially in relation to its inner peripheral surface.

There may be a pair of biasing members which may be spaced apart in the axial direction. These are preferably located at substantially the same radial distance from the turbine axis. They are preferably located in the same annular clearance between the support and the moveable member.

There may be further provided at least one seal disposed between the moveable member and the support. The at least biasing member may act (directly or indirectly) on the seal to bias it into sealing engagement with a surface of one or both of the moveable member or the support.

The at least one seal may be substantially axially aligned with the at least one biasing member. It may be disposed substantially radially inboard or outboard of the at least biasing member.

The at least one seal may be a piston ring.

The at least one seal may be axially spaced from the at least one biasing member. It may be disposed between axially spaced biasing members. In one embodiment the at least one biasing member is a resilient mesh, which may be a knitted metal mesh.

The mesh may optionally be filled by a suitable filler. The at least one seal may be U-shaped or V-shaped with the limbs of U- or V-shape sealing against respective surfaces.

The at least one biasing member may be disposed in a groove defined in one of the moveable member or the support. The at least one seal may similarly be disposed at least in part in said groove.

There may be provided an array of openings in the other of the first and second walls for receipt of the array of vanes.

The first wall may be defined by the axially moveable member. It may be integrally formed therewith or may be connected thereto by a releasable or non-releasable connection. The first wall may simply be an annular end of the axially moveable member. It may be in the form of a radially outwards extending flange which may be annular. The first wall may be a shroud defining the array of openings for receipt of the array of vanes. The first wall may be defined at a first end of the axially moveable member. An actuator assembly may be connected to a second end of the moveable member. The array of vanes is preferably fixed.

There may be provided a pair of seals, each seal having a sealing surface for sealing against a surface of the moveable member or the support, the sealing surface of each seal being disposed at substantially the same radial distance from the turbine axis.

Specific embodiments of the present invention will now be described, by way of example only, with reference to the accompanying drawings in which.

Figure 1:
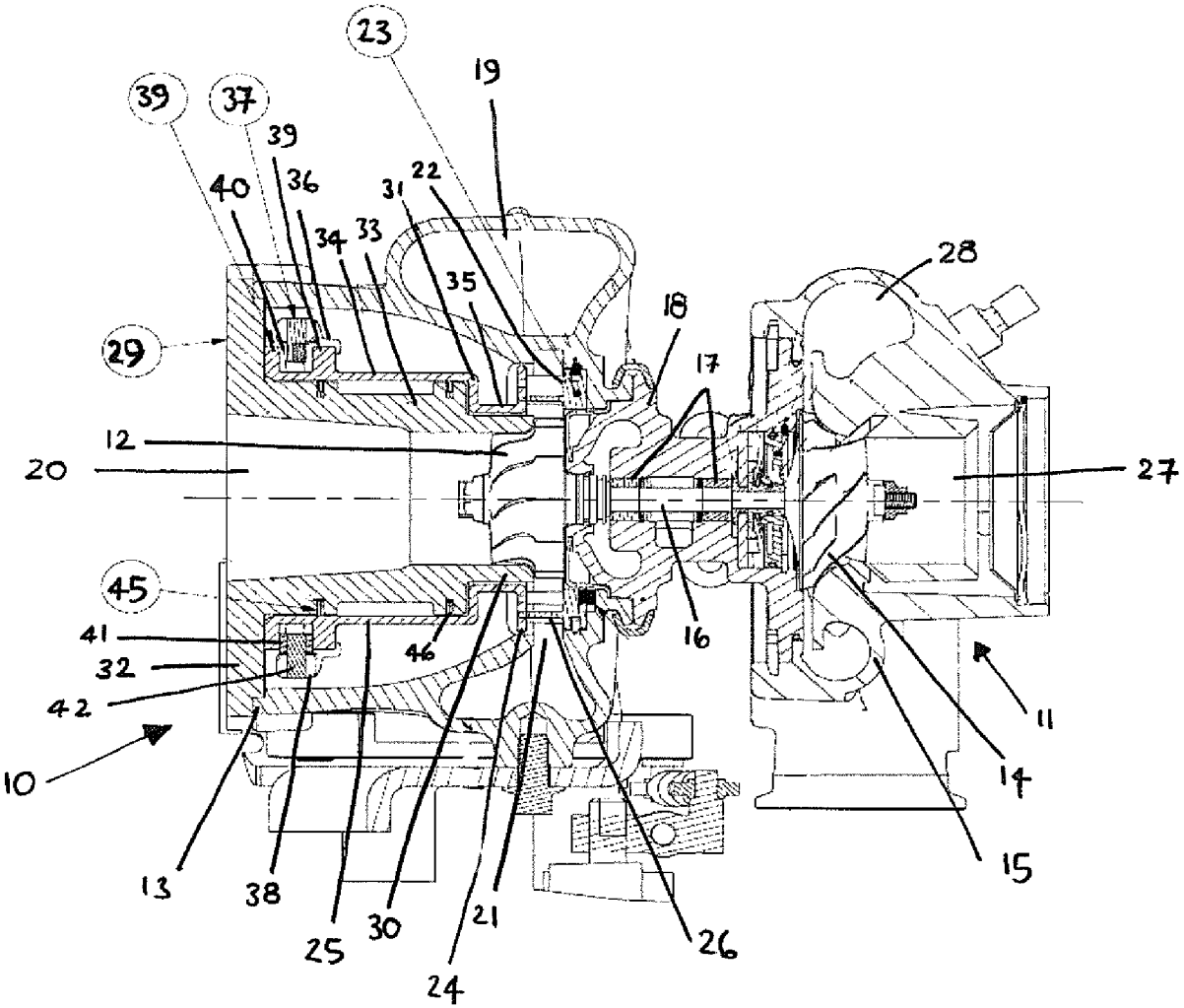
FIG. 1 is a sectioned side view of a turbocharger having a variable geometry turbine in accordance with one aspect of the present invention, the section passing through a central axis of the turbocharger.

Referring now to FIG. 1 of the drawings, the exemplary turbocharger comprises a variable geometry exhaust gas driven turbine 10 that drives a compressor 11.

The turbine 10 comprises a turbine wheel 12 rotatably disposed within a turbine housing 13. Similarly, the compressor 11 comprises a compressor impeller wheel 14 that rotates within a compressor housing 15. The turbine wheel 12 and compressor impeller wheel 14 are mounted on opposite ends of a common turbocharger shaft 16 that is rotatable on a pair of journal bearings 17 in a central bearing housing 18 connected between the turbine and compressor housings 13, 15.

The turbine housing 13 defines a volute or inlet chamber 19 to which exhaust gas from the exhaust manifold of the internal combustion engine is delivered. The exhaust gas flows from the inlet chamber 19 to an outlet 20 via an annular inlet passageway 21 defined on one side by a radial wall 22 of a fixed nozzle ring 23, and on the other side by a facing shroud 24 that is formed by a radially extending wall at one end of a sliding sleeve 25 which is described in more detail below.

The nozzle ring 23 is fixed in a recess in the turbine housing 13 and has a circumferential array of nozzle vanes 26 that extend across the inlet passageway 21 and pass through slots defined in the shroud 24. The sliding sleeve 25 is slidable in a direction substantially parallel to the axis of the shaft 16 such that the shroud 24 moves over the vanes 26 and varies the width of the inlet passageway 21.

Exhaust gas flowing from the inlet chamber 19 to the outlet 20 passes through the inlet passageway 21 and over the turbine wheel 12, which, as a result, drives the compressor impeller wheel 14 via the turbocharger shaft 16, which rotates on the journal bearings 17 in the bearing housing 18. Rotation of the compressor wheel 14 draws in air through a compressor inlet 27, and delivers compressed air to the inlet manifold of the engine via an outlet volute 28.

The turbine outlet 20 in this particular embodiment is defined by a separate component that is fixed to the rest of the turbine housing 13. It comprises a generally cylindrical member 29 having an internal surface that defines an internal exhaust gas outlet passage and an external surface on which the sliding sleeve 25 is concentrically disposed for axial movement. At an upstream end 30 of the member 29 the inner surface is immediately radially outboard of the exducer portion of turbine wheel 13 and is contoured to follow the profile of the outer periphery of the blades in that area such that the blades sweep that surface. The outer surface of the member 29 is inwardly stepped so as to define an annular shoulder 31 such that the upstream end 30 has a reduced outer diameter compared the rest of the member 29. At a downstream end there is a radially outward extending flange 32, the outer edge of which is connected to the rest of the turbine housing 13. Intermediate the flange 32 and the upstream end 30, the member 29 defines a substantially cylindrical supporting wall 33, the outer surface of which serves to guide the axial movement of the sliding sleeve 25.

The sliding sleeve 25 has a relatively large diameter portion 34 that is supported over the cylindrical supporting wall 33 and is inwardly stepped at the annular shoulder 31 so as to define a reduced diameter portion 35 that overlies the upstream end 30 of the member 29 and terminates in the radially outward extending shroud 24 which is generally annular. An end of the sleeve 25 distal from the shroud 24 is connected to a linkage which is driven by an actuator (not shown) for effecting axial displacement of the sleeve 25 relative to the supporting wall 33. The linkage is in the form of a yoke 36 having two arms 37, 38 the end of each of which is connected to the sleeve 25. The sleeve 25 has spaced annular ribs 39 that define an annular groove 40 between them which receives slidable pivot blocks 41 in which stub shafts 42 of the arms 37, 38 are pivotally received. The connection is such that the angular position of the sleeve 25 relative to the supporting wall 33 is not constrained. The actuator may take any appropriate from including pneumatic, hydraulic and electric forms, and can be linked to the yoke 36 in a variety of ways. By appropriate control of the actuator the axial position of the sliding sleeve 25 and therefore the axial position of the shroud 24 relative to the vanes 26 of the nozzle ring 23 can be controlled to determine the size of the annular inlet passageway 21. More particularly, the actuator is controlled to pivot the yoke 36 about a support shaft (not shown) which in turn causes the yoke arms 37, 38 to describe an arc or a circle so that the sliding sleeve 25 is moved axially with respect to the supporting wall 33, the off axis movement of the yoke arms 37, 38 being accommodated by sliding motion of the pivot blocks 41 within the groove 40. FIG. 1 shows the sliding sleeve 25 in its fully open position in which the shroud 24 is displaced from the facing radial wall 22 of the nozzle ring 23 such that the inlet passageway 21 is at its maximum width.

Figure 2:
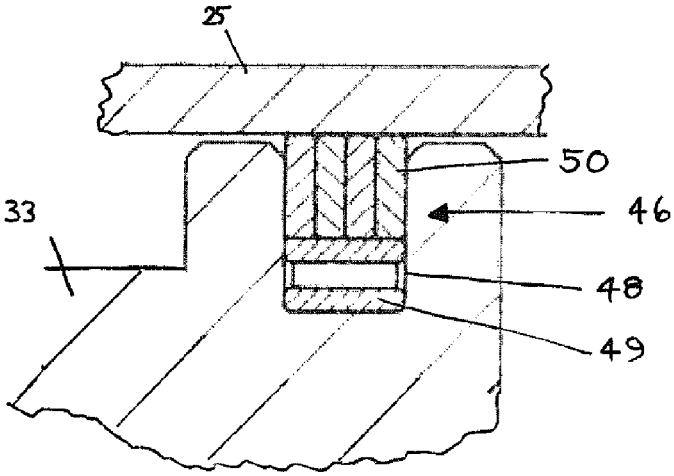
FIG. 2 is a sectioned side view of a resilient support of the variable geometry turbine of FIG. 2.

A pair of axially spaced resilient supports 45, 46 are disposed between the sliding sleeve 25 and the supporting wall 33 and serve to maintain the concentricity of the two components. The supports 45, 46 (shown in detail in FIG. 2) are disposed in respective annular grooves 47, 48 defined in the outer surface of the wall 33 and each comprise an inner radially acting expander ring (e.g. a wave spring) 49 on which a radially outer piston ring 50 is supported. The expander ring 49 serves to bias the piston ring 50 outwardly away from the wall 33 and against the inner surface of the sliding sleeve 25 thereby ensuring the sliding sleeve 25 and the shroud are maintained in a concentric relationship with the cylindrical member 29. The piston ring 50 shown in FIG. 2 is a laminated version that is formed from a plurality of turns (in this instance four turns) of the same ring or a plurality of separate, although a non-laminated version may be adopted. Piston rings of this kind are available from, for example, Fey Lamellenringe GmbH.

In other words, the resilient supports 45, 46 serve to maintain a small annular clearance between the sliding sleeve 25 and the supporting wall 33 such that it is of substantially constant radial dimension around its extent, whilst permitting relative axial movement between the sliding sleeve 25 and the wall 33. There is thus ordinarily no contact between the sliding sleeve 25 and the wall 33.

The adoption of the piston ring 50 is advantageous in that it may also provide sealing between the sliding sleeve 25 and the supporting wall 33 so as to prevent the passage of exhaust gas between the sleeve 25 and the wall 33.

The resilient support may be provided in a dedicated holder that is received in the groove 40 of the cylindrical member 29.

Figure 3:
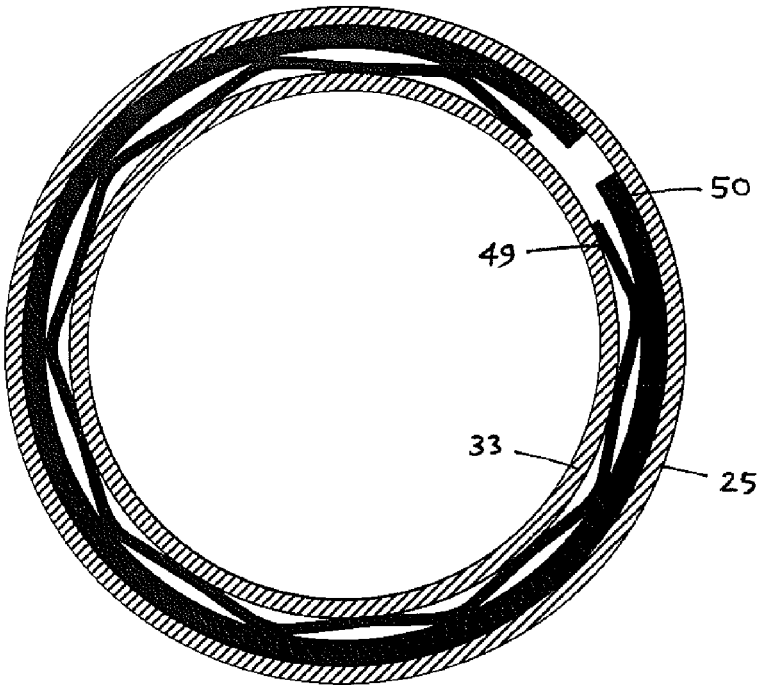
FIG. 3 is a schematic front sectioned view of an alternative resilient support shown between a supporting wall and a sliding sleeve of the variable geometry turbine of FIG. 1.

In FIG. 3 an embodiment of the piston ring 50 and resilient expander ring 49 is shown between the sliding sleeve 25 and the supporting wall 33 (both of which are represented schematically). The expander ring 49 is in the form of a wave spring that lies radially inboard of the piston ring 50.

In an alternative arrangement the resilient supports 45, 46 are disposed in a groove defined on the inner surface of the sliding sleeve 25 and radially acting compressor ring acts to bias the piston ring 49 so that its inner surface bears against the outer surface of the cylindrical wall 33.

Figure 4:
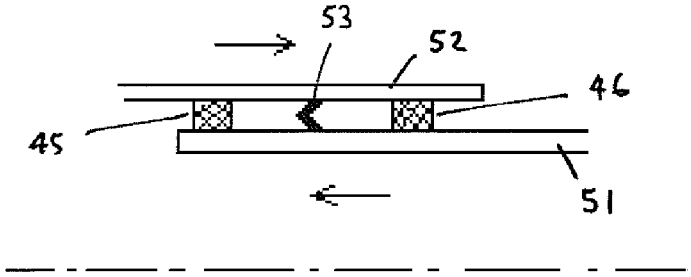
FIG. 4 is a schematic view of an alternative embodiment of the resilient support for the variable geometry turbine of FIG. 1.

In an alternative embodiment illustrated in FIG. 4, the resilient supports 45, 46 are provided by a pair of annular sleeves of resilient knitted wire mesh disposed between inner and outer cylindrical tubes 51, 52 that may be fixed respectively to the wall 33 and the sliding sleeve 25. In such an embodiment a separate seal 53 may be provided and an example is shown between the resilient supports in FIG. 4. In this particular embodiment the seal 53 has a V-shaped cross-section so that gas pressure across the seal serves to deflect the limbs of the V outwardly in a radial direction to seal against the respective tubes 51, 52. It will be appreciated that other seal cross-section shapes are possible (e.g. U-shaped) and indeed that a conventional piston ring seal may be provided in an annular groove on the sliding sleeve 25 or the wall 33. The seal 53 is slidable between the two mesh sleeves 45, 46. In one embodiment the mesh may be impregnated with a plugging or filler compound (e.g. grafoil). In one embodiment the seal 53 is made of wire mesh impregnated with graphite. An example of the wire mesh sleeves and seal combination is available from ACS Industries, Inc of Lincoln, R.I., USA. It will be appreciated that the tubes 51, 52 may be omitted and the mesh sleeves 45, 46 and seal disposed directly between the sliding sleeve 25 and the wall 33.

The diameter at which the (or each) seal 53 seals against on the sliding sleeve 25 is between the diameters occupied by the leading edges (i.e. the upstream radially outermost edges) and trailing edges (i.e. the downstream radially innermost edges) of the vanes. It has been realised that the seal diameter is a factor in the force required by the actuator to move the sleeve 25 and the chosen position reduces the overall average force required to move the sleeve in both directions.

It will be appreciated that in the embodiments where there is a seal, the centring and the sealing actions are provided by different components.

The expander ring 49 or the meshes 45, 46 of the different embodiments are configured to provide a biasing force that is distributed in a circumferential direction so as to ensure the radially acting biasing force serves to centre the sliding sleeve 25 on the wall 33. The force is thus substantially symmetrically distributed around the annular extend of each resilient support. It will be appreciated that to achieve the centring action radial force acts on both the sleeve 25 and the wall 33, either directly or indirectly. The biasing member in each case is deformable in the radial direction such that its outer peripheral surface is moveable radially in relation to its inner peripheral surface.

It will be appreciated that numerous modifications to the above described design may be made without departing from the scope of the invention as defined in the appended claims. For example, the precise shape of the sliding sleeve 25 and cylindrical support member 29 may be modified depending on the particular application. It will also be appreciated that in other embodiments the nozzle ring 23 may be fixed to the sliding sleeve 25 so that it moves axially therewith relative to a fixed shroud. Moreover, it will be understood that in an alternative arrangement the sliding sleeve 25 may be supported for axial movement by a radially outboard outer supporting wall instead of the radial inboard wall 33 shown in the figures. Furthermore, it will be appreciated that the radially outward extending shroud 24 may be eliminated and instead the end of the sliding sleeve may pass between the outer periphery of the turbine wheel and the vanes to vary the size of the annular passage and thus the cross sectional area available for gas as it approaches the turbine wheel.

The described and illustrated embodiments are to be considered as illustrative and not restrictive in character, it being understood that only the preferred embodiments have been shown and described and that all changes and modifications that come within the scope of the inventions as defined in the claims are desired to be protected. It should be understood that while the use of words such as "preferable", "preferably", "preferred" or "more preferred" in the description suggest that a feature so described may be desirable, it may nevertheless not be necessary and embodiments lacking such a feature may be contemplated as within the scope of the invention as defined in the appended claims. In relation to the claims, it is intended that when words such as "a," "an," "at least one," or "at least one portion" are used to preface a feature there is no intention to limit the claim to only one such feature unless specifically stated to the contrary in the claim. When the language "at least a portion" and/or "a portion" is used the item can include a portion and/or the entire item unless specifically stated to the contrary.

The invention claimed is:

1. A variable geometry turbine comprising a turbine wheel supported in a housing for rotation about a turbine axis, an inlet passageway defined between a first wall and second fixed wall, the first wall being moveable relative to the second wall in the direction of the turbine axis to vary the size of the inlet passageway, an array of vanes extending across the inlet passageway and fixed to one of the first and second walls, the first wall being moveable by a substantially annular axially moveable member that is supported by an substantially annular support, and at least one biasing member disposed between the moveable member and the support, the biasing member applying a substantially circumferentially distributed force in substantially the radial direction so as to maintain substantial concentric alignment of the annular support and the annular axially moveable member.

2. A variable geometry turbine according to claim 1, wherein the at least one biasing member is radially resilient.

3. A variable geometry turbine according to claim 1, wherein there is provided a pair of biasing members spaced apart in the axial direction.

4. A variable geometry turbine according to claim 1, further comprising at least one seal disposed between the moveable member and the support.

5. A variable geometry turbine according to claim 4, wherein the at least one biasing member acts on the seal to bias it into sealing engagement with a surface of one or both of the moveable member or the support.

6. A variable geometry turbine according to claim 4, wherein the at least one seal is substantially axially aligned with the at least one biasing member and is disposed radially inboard or outboard of the at least biasing member.

7. A variable geometry turbine according to claim 4, wherein the at least one seal is a piston ring.

8. A variable geometry turbine according to claim 4, wherein the at least one seal is axially spaced from the at least one biasing member.

9. A variable geometry turbine according to claim 8, wherein the at least one biasing member is a resilient mesh.

10. A variable geometry turbine according to claim 1, wherein the biasing member is disposed in a groove defined in one of the moveable member or the support.

11. A variable geometry turbine according to claim 1, wherein there is an array of openings in the other of the first and second walls for receipt of the array of vanes.

12. A variable geometry turbine according to claim 1, wherein the first wall is defined by the axially moveable member.

13. A variable geometry turbine according to claim 12, wherein the first wall is provided by a substantially annular flange of the axially moveable member.

14. A variable geometry turbine according to claim 13, wherein the first wall is defined at a first end of the axially moveable member.

15. A variable geometry turbine according to claim 14, wherein the axially moveable member has a second end which is connected to an actuator assembly.

* * * * *